US006012544A

United States Patent [19]

Backer et al.

[11] Patent Number: 6,012,544

[45] Date of Patent: Jan. 11, 2000

[54] AERIAL WORK PLATFORM WITH REMOVABLY ATTACHABLE SUPPORT STRUCTURE FOR AUXILIARY POWER PLANT

[75] Inventors: Robert D. Backer, Rouzerville; Brian S. Hess, Waynesboro; Danny J. Skidmore, Greencastle; Gregg A. Wagner, Chambersburg, all of Pa.

[73] Assignee: Grove U.S. L.L.C., Shady Grove, Pa.

[21] Appl. No.: 08/957,798

[22] Filed: Oct. 24, 1997

[51] Int. Cl.[7] ..... B66F 11/04

[52] U.S. Cl. ..... 182/2.7; 182/2.1

[58] Field of Search ..... 182/2.1, 2.11, 182/63.1, 69.4–69.6; 180/68.5

[56] References Cited

U.S. PATENT DOCUMENTS 1,734,645 11/1929 Polland .
3,667,563 6/1972 Korb .
3,719,881 3/1973 Shibata et al. .
4,019,604 4/1977 Benson .
4,058,182 11/1977 Huber .
5,251,721 10/1993 Ortenheim .
5,584,356 12/1996 Goodrich .

*Primary Examiner*—Alvin Chin-Shue

[57] ABSTRACT

The aerial work platform includes a support frame, wheels rotatably attached to the support frame, and an electric motor rotatably driving at least one of the wheels. A boom having a first end is pivotably mounted to the support frame, and a fluid motor raises and lowers the boom with respect to the support frame. A work platform is supported by a second end of the boom. A battery pack supplies power to the electric motor. A first support structure, for supporting an auxiliary power plant that supplements power supplied by said battery pack, removably attaches to the support frame.

4 Claims, 4 Drawing Sheets

AERIAL WORK PLATFORM WITH REMOVABLY ATTACHABLE SUPPORT STRUCTURE FOR AUXILIARY POWER PLANT

BACKGROUND OF THE INVENTION

1. Field of the Invention

The present invention relates to aerial work platforms; and more particularly, to an aerial work platform having a removably attachable support structure for auxiliary power plant.

2. Description of Related Art

Aerial work platforms such as disclosed in U.S. Pat. No. 5,584,356 to Goodrich include an electric motor for supplying motive power, and a battery pack for supplying power to the electric motor. When the charge on the battery pack decreases below an operational threshold level, the batteries must be recharged using known battery chargers. During this recharging period, the aerial work platform is unavailable for use.

Often, such aerial work platforms need to be driven some distance to reach a work site. Unfortunately, driving to the work site can drain the battery pack to such a level that recharging is required.

SUMMARY OF THE INVENTION

One object of the present invention is to provide an aerial work platform which overcomes the problems and disadvantages discussed above.

An object of the invention is to provide an aerial work platform which can operate for extended periods without an external source of electrical power.

Another object of the present invention is to provide an aerial work platform having a removably attachable support structure for an auxiliary power plant.

These and other objects are achieved by providing an aerial work platform, comprising: a support frame; wheels rotatably attached to said support frame; an electric motor rotatably driving at least one of said wheels; a boom having a first end pivotably mounted to said support frame; a fluid motor raising and lower said boom with respect to said support frame; a work platform supported by a second end of said boom; a battery pack supplying power to said electric motor; and a first support structure for supporting an auxiliary power plant that supplements power supplied by said battery pack, said first support structure removably attaching to said support frame.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
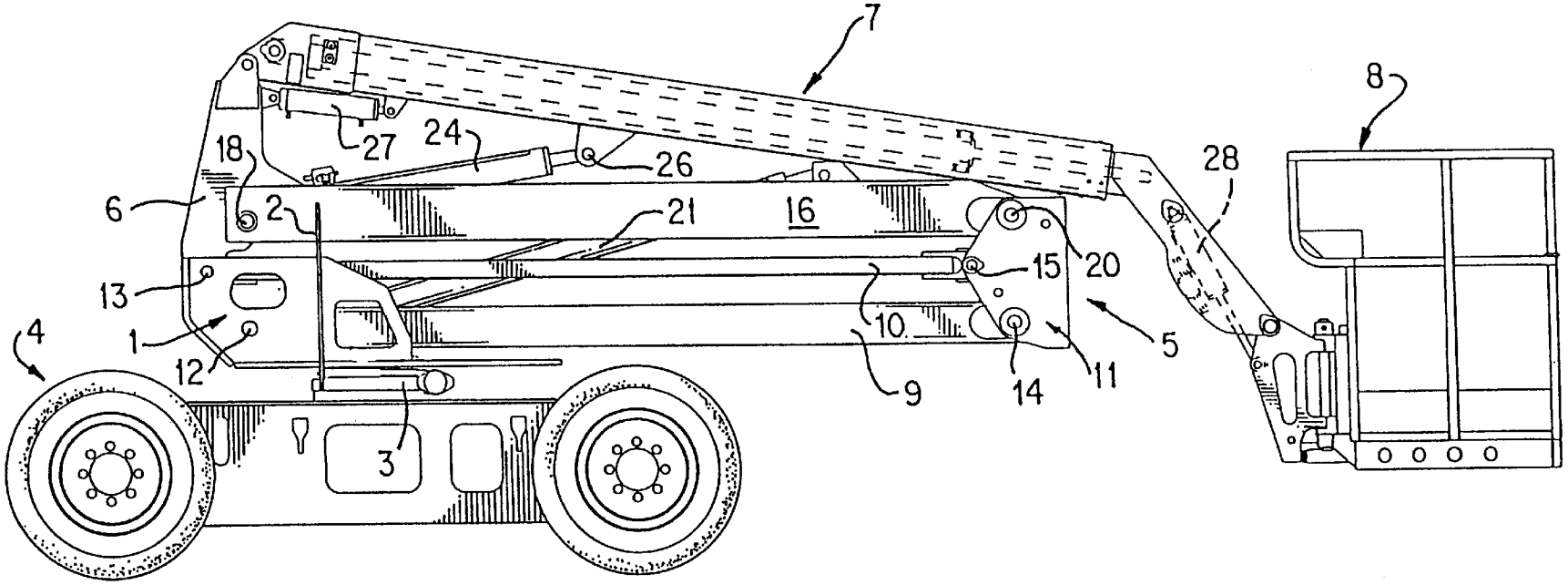
FIGS. 1 and 2 illustrate the aerial work platform according to the present invention in a retracted and extended state, respectively.
Figure 2:
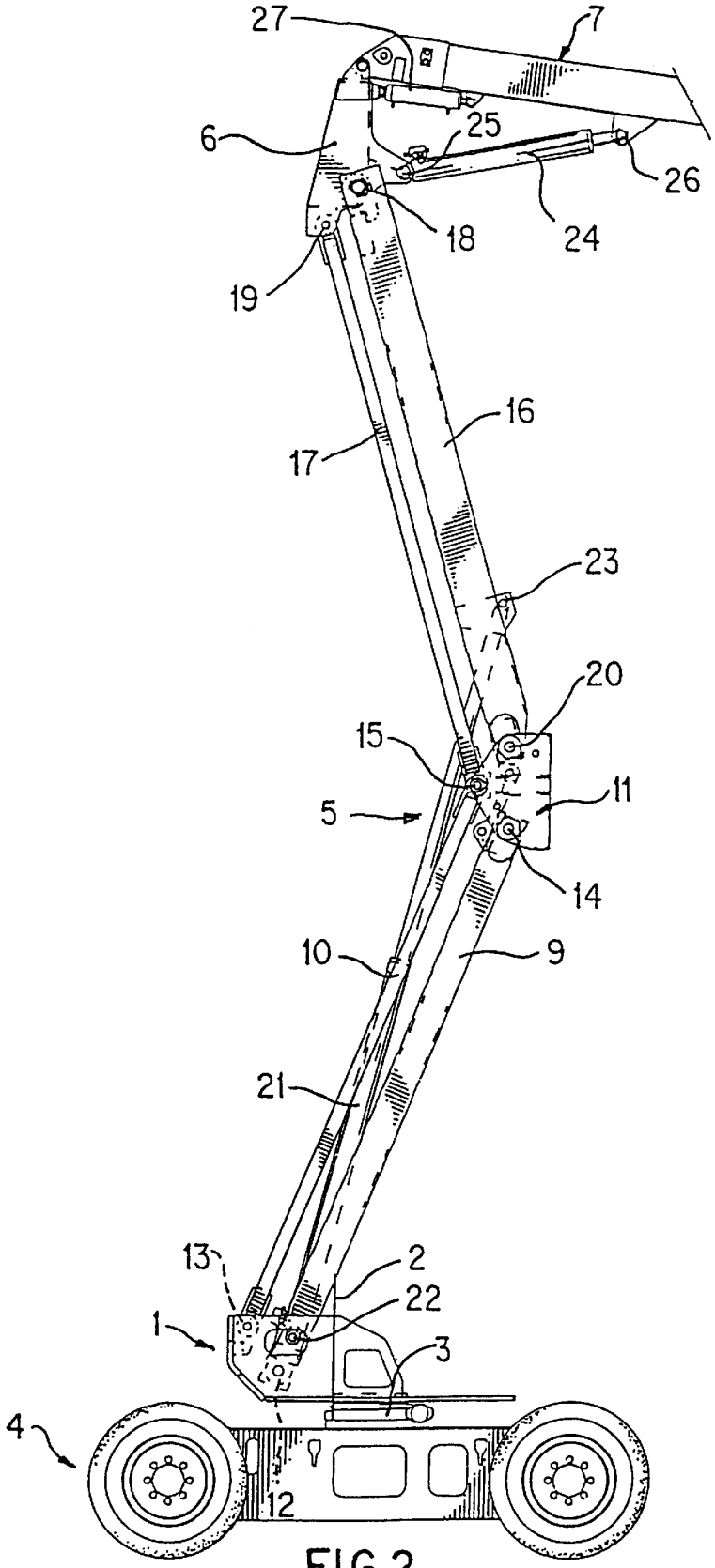

FIGS. 1 and 2 illustrate the aerial work platform according to the present invention in a retracted and extended state, respectively. The aerial work platform includes a superstructure support frame 1, having vertically extending plates 2 upon which counterweights, not shown, are adapted to be mounted. The support frame is mounted on a turntable 3 carried by a vehicle chassis 4. An articulated parallelogram boom assembly 5 is operatively connected between the support frame 1 and a riser 6 connected to the proximate end portion of telescopic boom assembly 7 having a work platform 8 mounted on the distal end thereof.

The articulated parallelogram boom assembly 5 includes a lower boom assembly having pairs of parallel, laterally spaced compression and tension arms 9 and 10, respectively, extending between the support frame 1 and a floating frame 11. The compression and tension arms 9 and 10 are pivotally connected to the support frame as at 12 and 13, and to the floating frame as at 14 and 15. The articulated parallelogram boom assembly 5 also includes an upper boom assembly having pairs of parallel, laterally spaced compression and tension arms 16 and 17, respectively, extending between the riser 6 and the floating frame 11. The compression and tension arms 16 and 17 are pivotally connected to the riser as at 18 and 19, and to the floating frame 11, as at 20 and 15. An extensible hydraulic cylinder 21, positioned on the centerline of the machine, is pivotally connected as at 22 to and between the lower compression arms 9, and as at 23 to and between the upper compression arms 16; whereby, when the cylinder 21 is retracted, the parallelogram assembly 5 is in the folded position, as shown in FIG. 1, and is in the elevated position, as shown in FIG. 2, when the hydraulic cylinder 21 is extended.

A boom lift cylinder 24 is similarly pivotally connected along the centerline of the machine, above the cylinder 21, between the riser 6, as at 25, and the telescopic boom assembly 7, as at 26. The remaining components on the telescopic boom assembly 7 include a master hydraulic cylinder 27 for controlling a slave cylinder 28 on the distal end of the telescopic boom assembly 7 for maintaining the work platform 8 in a horizontal position during the raising and lowering of the parallelogram assembly 5 and the luffing of the telescopic boom assembly 7 with boom lift cylinder 24. In the folded or retracted position of the parallelogram assembly 5, the cylinder 21 is nested between the pairs of arms 9, 10, 17, and 16; the boom lift cylinder 24 is nested between arms 16 above the cylinder 21; and the master hydraulic cylinder 27 as well as the cylinder inside the telescopic boom assembly 7, for extending and retracting the same, are positioned above the other cylinders on the centerline of the machine.

Figure 3:
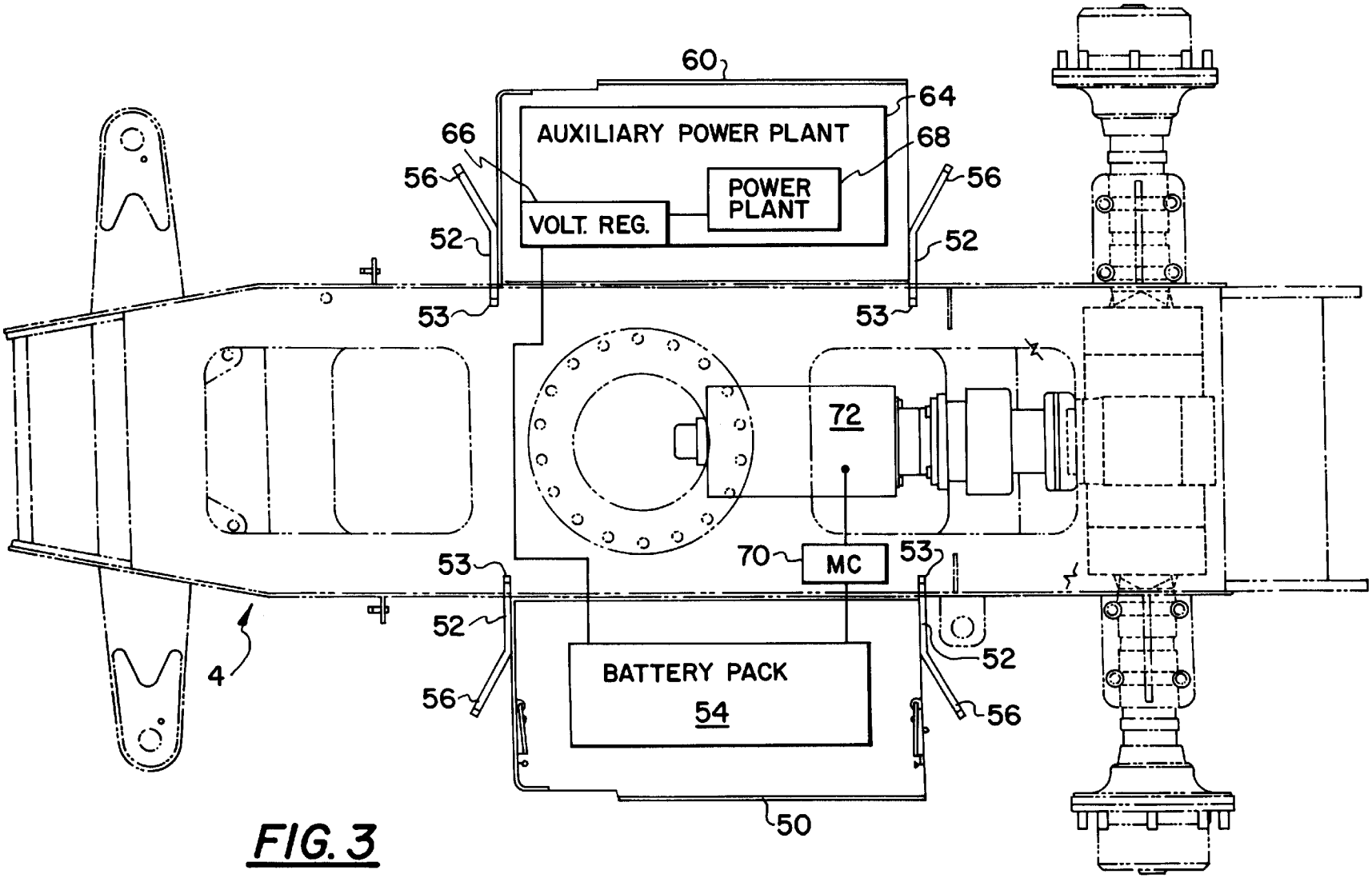
FIG. 3 illustrates a top down view of the vehicle chassis for the aerial work platform according to the present invention.

FIG. 3 illustrates a top down view of the vehicle chassis 4 for the aerial work platform according to the present invention. As shown in FIG. 3, a first tray 50, connected by hooks 52 in a cantilever fashion to the vehicle chassis 4, supports a battery pack 54. The battery pack 54 includes a plurality of batteries connected in series to produce a predetermined voltage. A portion of each member forming the hooks 52 bends away from the first tray 50 to form ears 56.

Figure 4:
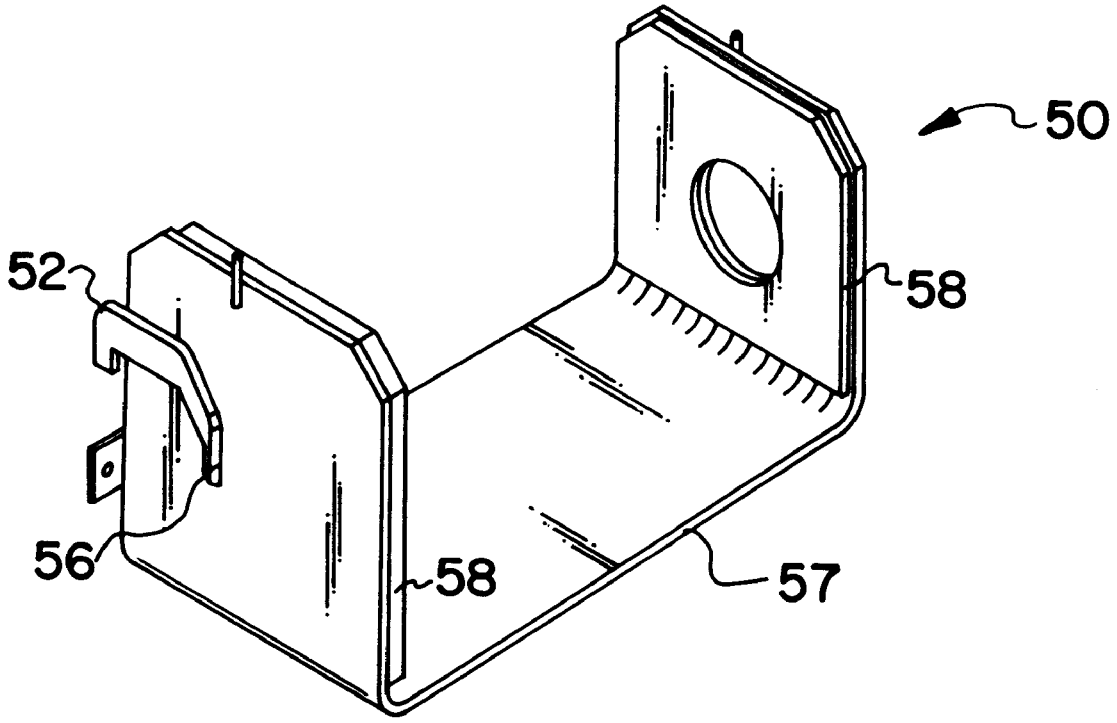
FIG. 4 shows a perspective view of the first tray in the aerial work platform according to the present invention.

FIG. 4 shows a perspective view of the first tray 50. As shown, the first tray 50 has a bottom 57 with side walls 58 extending therefrom. Each side wall 58 has a hook 52 fixed thereto. A portion of the member forming each hook 52 bends away from the side wall 58 to form an ear 56.

The ears 56 facilitate hooking the first tray 50 on the vehicle chassis 4. For instance, cables can be hooked onto the ears 56, and the first tray 50 with the battery pack 54 thereon lifted by means of the cables to hook the first tray 50 on the vehicle chassis 4 by inserting hooks 52 into slots 53 in the side of chassis 4 (FIG. 1).

Similarly, a second tray 60, identical in structure to first tray 50, is connected by hooks 52 in a cantilever fashion to slots 53 in the opposite side of vehicle chassis 4. The second tray 60 supports an auxiliary power plant 64 which includes a voltage regulator 66 connected to a power plant 68. As shown, the voltage regulator 66 is connected to the battery pack 54.

A motor controller 70 is also connected to the battery pack 54 and, in addition, is connected to an electric motor 72. The electric motor 72 drives the rear wheels of the aerial work platform. Besides supplying power to the electric motor 72, the battery pack 54 powers the hydraulic control system (not shown) of the aerial work platform.

In operation, the motor controller 70 regulates the voltage output by the battery pack 54 in accordance with user input received via, for instance, a throttle, and supplies the regulated voltage to the electric motor 72. Because the first tray 50 is removably attachable to the vehicle chassis 4 via hooks 52, the battery pack 54 can be readily hooked and unhooked from the vehicle chassis 4. After hooking the first tray 50 on the vehicle chassis 4, the battery pack 54 is electrically connected to the motor controller 70 via, for instance, cables. The battery pack 54 can also be connected to the auxiliary power plant 64 via, for instance, cables, if such a power plant is provided for the aerial work platform. It should be understood that, according to the invention, the auxiliary power plant may be selectively provided for the aerial work platform.

The power plant 68 in the auxiliary power plant may be any type of well-known power plant which generates electric power. For example, in one embodiment the power plant 68 is a voltage generator driven by a gasoline or diesel powered combustion engine. As another example, the power plant 68 is a voltage generator driven by a propane engine. In a preferred embodiment, the power plant 68 is a Kubota ZB600 diesel engine driving an alternator and generator. Although the following details do not form part of the presently claimed invention, in order to reduce the size, noise, and heat characteristics in the above system using the Kubota diesel engine, certain modifications can be made such as mounting the alternator and generator to the engine, changing the exhaust silencing system, and remotely mounting the coolant system, water pump, drive system, and air cleaning system within the second tray 60.

The voltage generated by the power plant 68 is supplied to the voltage regulator 66. The voltage regulator 66 may be any well-known voltage regulator. The voltage regulator 66 monitors the voltage or charge on the battery pack 54, and when the charge on the battery pack 54 decreases below a predetermined threshold voltage, the voltage regulator 66 supplies the voltage generated by the power plant 68 to the battery pack 54. More specifically, the voltage regulator 66 controls the amount of current flowing to the battery pack 54 based on the difference between the charge on the battery pack 54 and the predetermined threshold voltage. Unlike the voltage output by the battery pack 54, the voltage supplied by the voltage regulator 66 includes fluctuations unwanted in a power supply for an electric motor. However, because the voltage output from the voltage regulator 66 charges the battery pack 54, as opposed to serving as a direct power supply for the electric motor 72, the battery pack 54 operates as a filter to remove such fluctuations.

As with the first tray 50, because the second tray 60 is removably attachable to the vehicle chassis 4 via hooks 52, the auxiliary power plant 64 can be readily hooked and unhooked from the vehicle chassis 4. After hooking the second tray 60 on the vehicle chassis 4, the voltage regulator 66 is electrically connected to the battery pack 54 via, for instance, cables.

When lengthy aerial work platform operation is required, such as when driving an extended distance to a work site, the second tray 60 with the auxiliary power plant 64 thereon can be hooked onto the vehicle chassis 4, and then placed in operation so as to maintain the battery pack 54 charged and operational. The auxiliary power plant 64 is also useful when the aerial work platform must be used for an extended period at a location where electric power is not available for recharging the battery pack 54. However, in those environments which prohibit the use of, for example, internal combustion power plants, the second tray 60 is easily removed from the vehicle chassis 4, by unhooking the second tray 60 therefrom. Accordingly, the aerial work platform according to the present invention is extremely versatile. In a similar manner, the battery pack 54 can easily be replaced or exchanged because the first tray 50 supporting the battery pack 54 is also removably attachable to the vehicle chassis 4.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed:

1. An aerial work platform, comprising:

a chassis support frame;

wheels rotatably attached to said chassis support frame;

an electric motor rotatably driving at least one of said wheels;

a boom having a first end pivotably mounted to said chassis support frame;

a fluid motor raising and lowering said boom with respect to said chassis support frame;

a work platform supported by a second end of said boom;

a battery pack supplying power to said electric motor; and a first cantilever support structure for supporting an auxiliary power plant that supplements power supplied by said battery pack, said first support structure including a tray and at least one hook, said hook removably attaching said first cantilever support structure on said chassis support frame in a cantilevered manner by hooking said hook onto said chassis support frame.

2. The aerial work platform of claim 1, wherein said first cantilever support structure further comprises:

a pair of projecting members projecting from said tray.

3. The aerial work platform of claim 1, further comprising:

a second support structure supporting said battery pack, said second support structure removably attaching to said chassis support frame so that said battery pack removably attaches to said aerial work platform.

4. The aerial work platform of claim 3, wherein said second support structure is a cantilever support structure which removably attaches to said chassis support frame in a cantilevered manner.

* * * * *